US005625982A

United States Patent [19]

Foote

[11] Patent Number: 5,625,982

[45] Date of Patent: May 6, 1997

[54] ARTICULATED DOME

[76] Inventor: Byron N. Foote, 50 Cold Spring Dr., West Warwick, R.I. 02893

[21] Appl. No.: 278,863

[22] Filed: Jul. 15, 1994

[51] Int. Cl.[6] ..... E04B 1/346

[52] U.S. Cl. ..... 52/64; 52/67; 52/71

[58] Field of Search ..... 52/80.1, 64–72, 52/82, 91.1, 6; 135/132, 133, 135, 147, 148

[56] References Cited

U.S. PATENT DOCUMENTS

| | | | |
|---|---|---|---|
| 1,572,790 | 2/1926 | Grigsby | 52/67 |
| 2,728,115 | 12/1955 | Cornelius | 52/67 |
| 4,583,331 | 4/1986 | Hunt et al. | 52/71 X |
| 4,833,837 | 5/1989 | Bonneau | 52/66 X |
| 4,995,203 | 2/1991 | Brisbin et al. | 52/64 X |
| 5,070,659 | 12/1991 | Brisbin et al. | 52/64 X |

*Primary Examiner*—Carl D. Friedman
*Assistant Examiner*—Beth A. Aubrey
*Attorney, Agent, or Firm*—Salter & Michaelson

[57] ABSTRACT

A frameless self-supporting articulated dome is constructed in two opposing halves that overlap at the domes meridian to form a sealed hemispherically shaped closure when the dome is in a closed position. The dome includes a plurality of overlapping flat and flexible fins which are progressively sized and rotatably pinned at their ends along a common horizontal axis whereby said fins are in a stacking relation on opposing sides of the horizontal axis when the dome is in an open position. The dome further includes measured lengths of flexible cord fastened to the center trailing edge of each fin in series for holding the plurality of fins in their relative positions when the dome is in a closed position and further additional lengths of the same flexible cord are fastened to the center leading edges of the top most fins of each half of the dome for manually opening and closing the dome.

6 Claims, 3 Drawing Sheets

ARTICULATED DOME

BACKGROUND OF THE INVENTION

This invention relates to the construction of an articulated hemispherical dome which is primarily intended for use as an observatory roof that may be opened to any degree desired, such as from a slit to a fully exposed hemisphere in order to view the sky. When the dome is fully closed, the dome forms a weather-tight roof to protect the observer and his equipment.

The concept of a folding or collapsible building or roof has been with us for some time. Many variations on this particular theme exist as prior art to this: invention. These variations fall into two main categories: collapsible structures covered with rigid sheathing; and collapsible framed structures with fabric coverings.

Examples of the first category of folding systems can be seen by examining the following art: U.S. Pat. No. 1,572,790, dated Feb. 9, 1926, titled "Garage" by H. S. Grigsby. Mr. Grigsby presents a two-piece, folding, hemispherically-shaped building made up of sections of sheet metal arches which are rigidly secured to a curved metal frame that defines its shape. The metal arches are further pivotal along a common horizontal axis. Half of this particular structure can be opened at a time to allow a vehicle to pass into and if desired, through the building. A further refinement to Mr. Grigsby's invention is the "Folding, Collapsible, Portable Building" represented in the U.S. Pat. No. 2,728,115, dated Dec. 27, 1995, by G. Cornelius. This structure is a complex but versatile building in a semi-cylindrical shape with extendible, overlapping, transversely curved rigid roof sections held in position by semi-circular end walls which are pivotal along a common horizontal axis, but also hinged along one outer longitudinal edge. Cornelius's building allowed access at ground level to the entire interior of the structure, and then was able to close the structure into a weather-tight housing. A third and even more complex example of a folding roof can be found in U.S. Pat. Nos. 4,995,203 and 5,070,659, authored on Feb. 26, 1991, and Dec. 10, 1991, respectively, by Brisbin, et al., titled "Retractable Roof for Stadium Structure". These patents feature an amazingly complex and specific stadium roof composed of two opposing, rigid, overlapping roof assemblies on separate pivot mechanisms, which through a system of weighted floats in liquid reservoirs, pulleys, cables and hydraulics allow the roof sections to be opened, closed, or to be maintained in an intermediate position. This structure also requires a complex foundation for support.

The second category of folding structures, those with fabric coverings, are typically constructed of one or more layers of fabric stretched over multiple rigid frame members, the frame members being pivotal and the fabric acting to weatherproof the building and to maintain the spacing of the frame members when the structure is closed. Variations on this theme can be seen in the following art.: U.S. Pat. No. 4,583,331, by Hunt et al., dated Apr. 22, 1986, titled "Frame Supported Structure with Tensioned Fabric Panels"; U.S. Pat. No. 4,833,837, by Bonnea, dated May 30, 1989, titled "Folding Radome"; and U.S. Pat. No. 5,004,001, by Bouchard, dated Apr. 2, 1991, titled "Foldable Dome".

The available prior art depicting folding and collapsible structures share similar disadvantages for the builder when compared to the present invention to be described hereinafter. These disadvantages include: a dependence on an internal framework to support the structure; radiused, flanged interlocking parts that are difficult to manufacture; complex operating mechanisms; a necessary understanding, talent and expertise in a variety of arts including training in advanced engineering disciplines and mathematics to construct and operate the devices; as well as extensive tooling requirements for fabrication of the structures.

The motivations that inspired the present invention of an "Articulated Dome" include the desire to create a structure that fulfilled the requirements of protection and access necessary for an observatory roof, and simple enough in design to be built by anyone with a basic knowledge of mathematics, familiarity with basic hand tools (or simple power tools if available), and access to common materials available at the local level.

SUMMARY OF THE INVENTION

This invention relates to a novel enclosure in the form of a hemispherical-shaped, articulated dome, ostensibly for use as an observatory roof, but also able to function as a blind or general shelter, which by the nature of its use needs to be resilient, weather resistant, routinely opened for observation and access, and closed for protection from the elements.

The articulated dome is a frameless, self-supporting structure composed of multiple, overlapping, flat, flexible, progressively sized fins, which are bent along an arc, and rotatably pinned at their ends to pivot assemblies located at opposite ends of a common horizontal axis. This dome is constructed in two opposing halves that overlap at the meridian of the enclosure. The bottom fins of each half of the dome are also secured at their midpoints between the pivot assemblies thereby defining the great circle of the dome's hemispherical shape. As the dome is opened, the individual fins stack upon each other on opposite sides of the dome's common horizontal axis.

The individual overlapping fins of the dome are held in their relative positions by measured lengths of flexible cord or cable which are attached to the center of the trailing edge of each fin, in series, with a mechanical fastener. When the dome is in its open position, these cords are stretched taught, maintaining the spacing of the fins:. When the dome is opened, the fasteners attached to the fins act as stops as the fins stack upon each other keeping them from fully overlaying each other and binding together. The dome is operated by additional lengths of flexible cord that are attached to the leading edges of the top fin of each half of the dome, which by pulling in opposite directions, opens or closes the dome.

As the dome is assembled, the ends of the flat flexible fins are attached to the opposing pivot mechanisms in order of their progressive lengths. This is accomplished by bending each fin in an arc from pivot to pivot. This results in an outward pressure on the fins causing the leading edge of each fin to contact the underside of the next fin continuously from pivot to pivot. This continuous contact forms a weather-tight seal between each fin. As the dome is opened and closed, each fin remains in contact with the next, effectively weather-proofing the structure with the exception of a continuous gap between the top fins of the two halves of the dome. This gap is closed with a flexible gasket attached to the top most fin of one half of the dome which contacts the top most fin of the other half of the dome extending from pivot assembly to pivot assemble along the meridian of the dome.

The ends of the fins are trapped between metal disks on the pivot assemblies keeping them at right angles to the pivots and maintaining the hemispherical shape of the dome.

Accordingly, it is an object of the invention to provide an articulated roof structure comprising a plurality of curved fins which are rotatably pinned at their respective ends.

Other objects, features, and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 6 is a perspective view of the instant invention.

DETAILED DESCRIPTION OF THE PREFERRED EMBODIMENT

Figure 1:
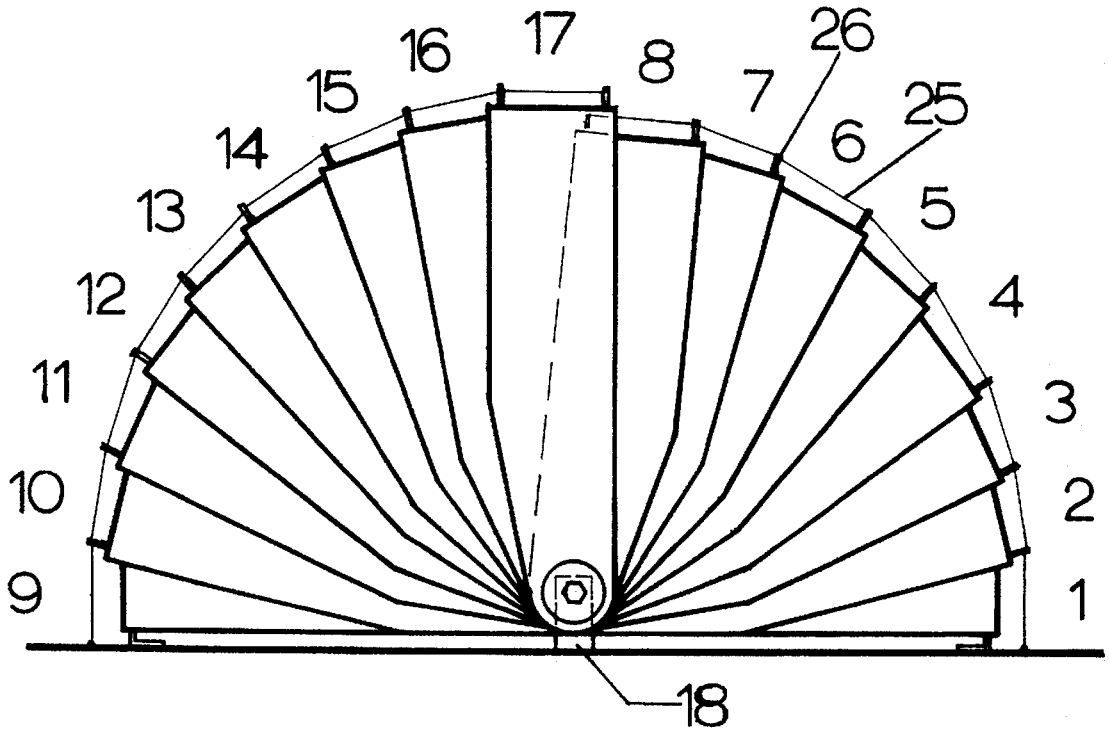
FIG. 1 is a side view of the dome of the instant invention in a closed position.

Referring to FIGS. 1 and 6, the dome of the present invention comprises a plurality of overlapping, flat, flexible fins 1 through 17, bent into a hemispherical shape and rotatably pinned at the opposite ends of a common horizontal axis. The pivot assemblies 18 at which the fins are pinned are secured to the support structure of the dome. Fins 1 and 9 are mounted in an inverted position and also secured to the dome support structure at their center (see FIG. 5) thus providing fixed points by which their locations define the great circle of the dome.

Figure 2:
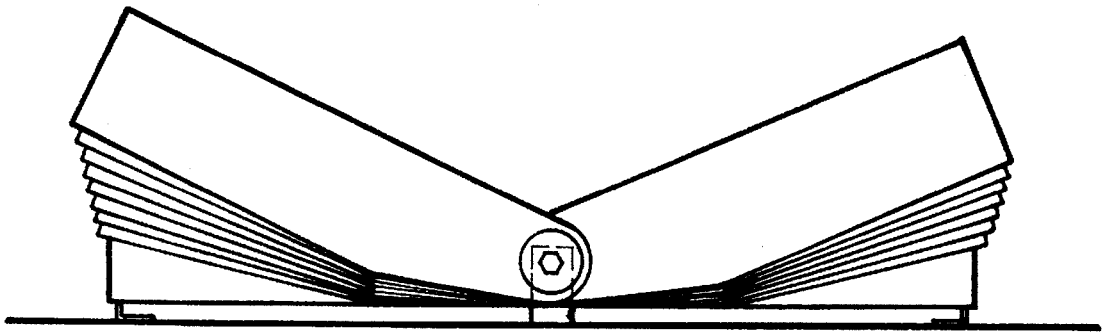
FIG. 2 is a side view thereof in an open position.

The structure is composed of segmented halves that overlap at the meridian of the enclosure when closed, as shown in FIG. 1. The fins 1–17 that comprise the dome walls collapse in opposite directions when opened as pictured in FIG. 2. As the dome opens, the fins stack upon each other in order of ascending size. The mechanical fasteners (see 26 on FIG. 5) attached to the fins trailing edges prevent the fins from fully overlaying and binding together.

Figure 3:
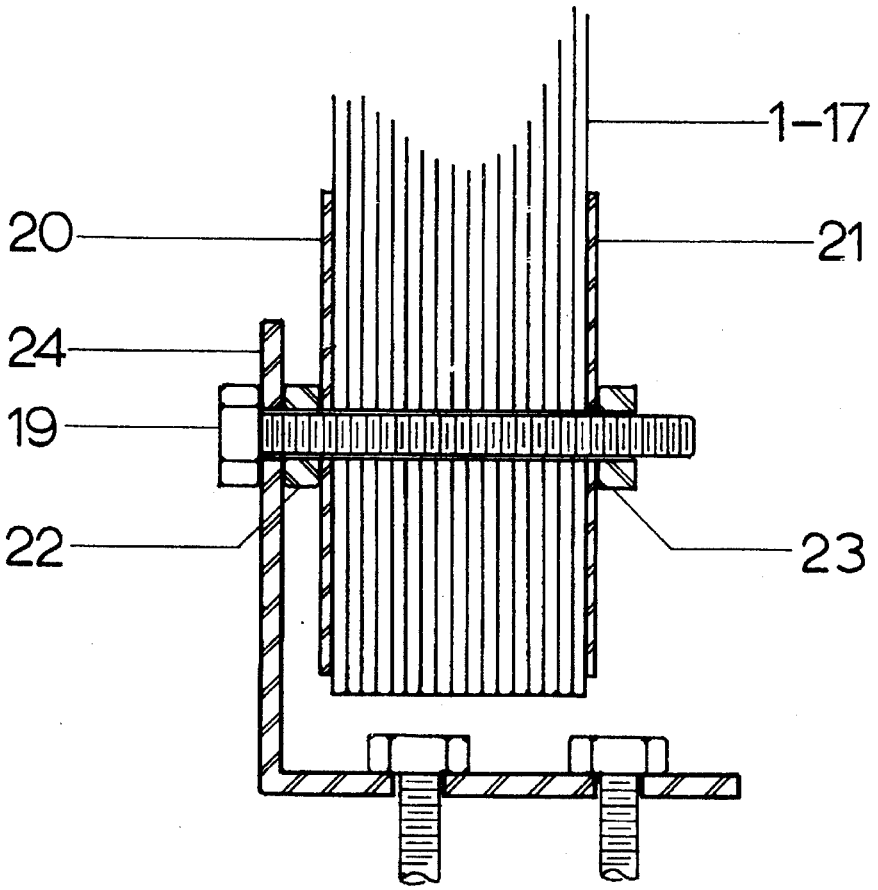
FIG. 3 is a cross-sectional view taken along line 3—3 of FIG. 1.

FIG. 3 details one of the pivot assemblies 18 shown also in FIG. 1. The fins 1 through 17 are rotatably pinned on bolt 19, flanked by metal disks 20 and 21, and held in place by nuts 22 and 23. This condition is typical for both pivot assemblies. The metal disks distribute the stress at the ends of the fins caused when they are bent and secured to the pivot bolt. The disks further maintain the fins at right angles to the bolt, thus maintaining the hemispherical shape of the dome along its vertical section. Each half of the dome can be operated independently, and thus it is possible to adjust the dome as required to compensate for varying conditions of wind, light, and weather. The pivot bolt is held in position by the support angle 24 which in turn, is secured to the dome support structure.

Figure 4:
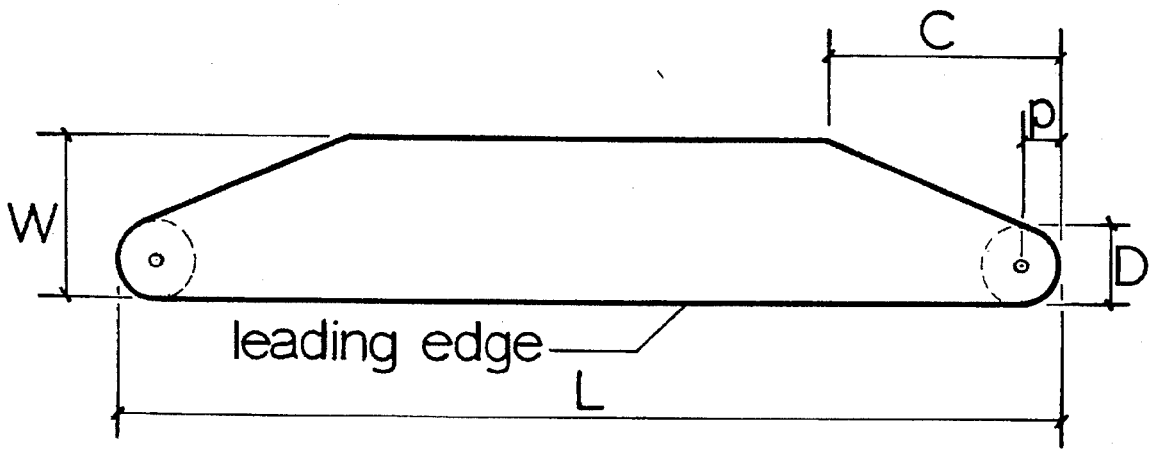
FIG. 4 is a side view of an individual fin of the instant invention.

Referring to FIG. 4, there is represented a typical fin comprising the dome wall. These fins may be made of any thin flexible material such as fiberboard, plastic, or metal. The lengths of the fins are a function of the size of the dome to be built, each fin being larger than the preceding fin by one and one-half times the thickness of the material being used. Each fin 2 through 17 is slightly longer than the preceding fin, thereby allowing them to stack upon each other as the dome is opened in order of their ascending size. The length 'L' of the first fin can be determined by the equation;

$$L=(\Pi\times D)\div 2$$

where 'D' is the diameter of the dome to be built. Each additional fin is progressively larger than the preceding fin, the length 'l' being derived by the equation;

$$l=L+(1.5\times T)$$

where 'L' is the length of the first or preceding fin, and 'T' is the thickness of the fin material. The width 'W' of each fin is constant and may be determined by the equation;

$$W=\frac{(\Pi\times D)\div 2}{N}\times 1.4$$

where 'D' is the diameter of the dome and 'N' is the number of fins to be used.

There is a relationship between the number of fins and the successful functioning of the dome. FIG. 1 shows an enclosure using 17 fins. This number was derived through experimentation, and may vary with the size of the dome and the material used for the fins. Fins may be added or removed if necessary, for the proper functioning of the dome.

The position 'P' of the pivot bolt hole at the end of each fin is determined by the equation;

$$P=0.25\times W$$

where 'W' is the width of the fin. This location is constant with one pivot hole to be located at each end of each fin and measured inward from the ends and along the leading edge of the fin. The pivot holes must be bored slightly larger than the pivot bolt diameter for ease of assembly and operation. The pivot holes in fin 1 and 9 must also be elongated along an axis parallel to the leading edge by a factor of twice the diameter of the pivot hole of the other fins so that their assembled position will fall inside that of the other fins. The shaped end of each fin is also constant. This shape allows the fins to stack in close succession as the dome is opened. This shape is generated by first drawing a circle centered on the pivot hole location the diameter 'd' of which is determined by the equation;

$$d=0.5\times W$$

where 'W' is the width of the fin. A line tangent to the circle is then drawn to a point 'C' measured from the fin end inward along its trailing edge, the location of which is determined by the equation;

$$C=1.5\times W$$

Figure 5:
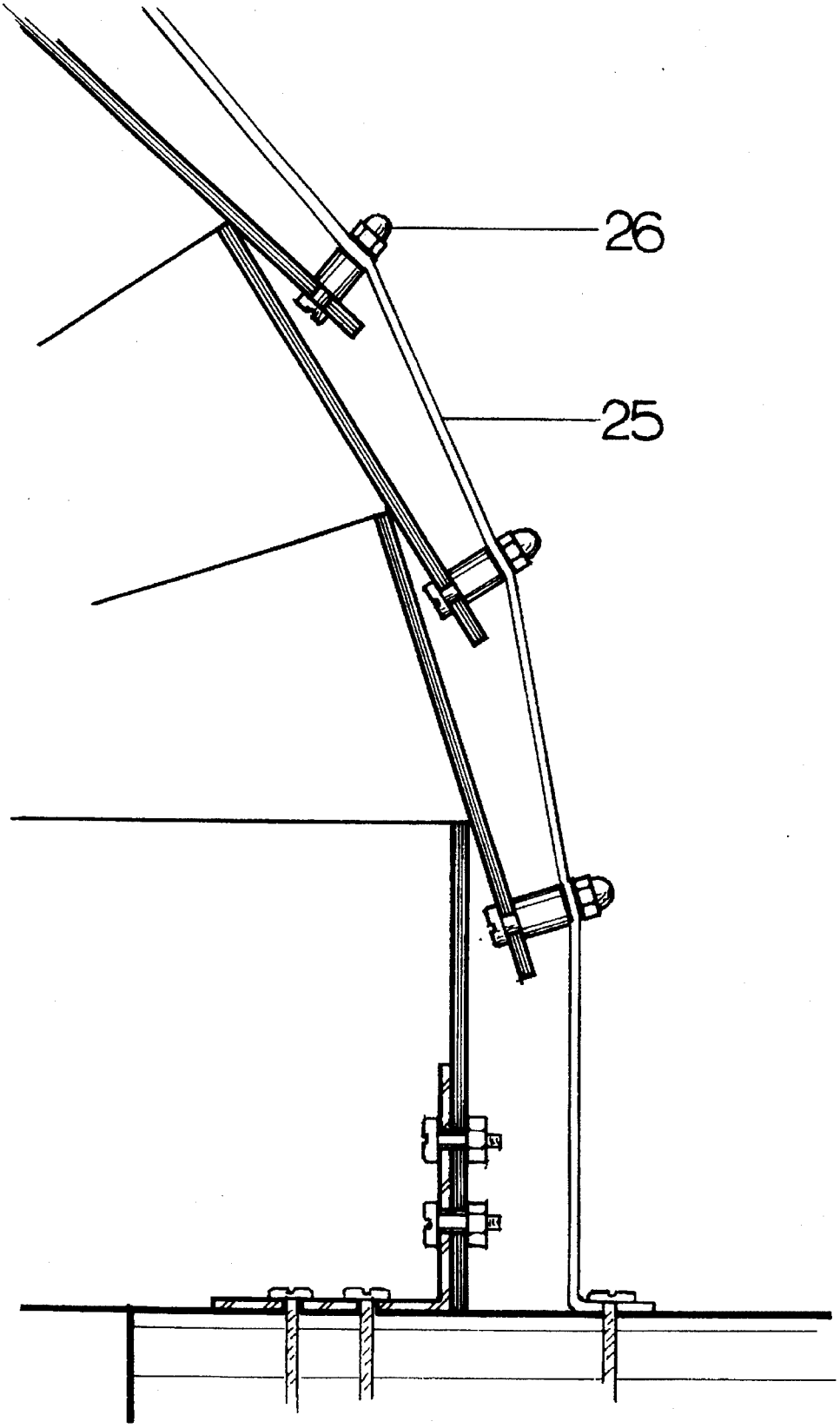
FIG. 5 is an enlarged fragmentary side view showing the fins respective relation to each other.

FIG. 5 details the connecting links between the dome fins that allow them to act together. The fins are held in position by measured lengths of flexible cord or cable attached to the center of the trailing edge of each fin with a mechanical fastener 26. The mechanical fasteners that secure the cords to the fins also act as stops preventing the fins from fully overlaying each other and binding together as the dome is opened. An additional length of cable is attached to the leading edge of the top fin of each side of the dome which by pulling in opposing directions is used to open and close the structure. The pressure resulting front bending the fins and attaching them to the pivot mechanisms during assembly causes the leading edge of each fin to contact the underside of the next fin in a continuous manner, from pivot to pivot, so that the dome is self-sealing and weather-tight when closed, with the exception of a continuous gap between the two halves of the dome. This gap is sealed by a gasket mounted to fin 17 running from pivot to pivot and contacting fin 8 in a continuous manner.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A frameless self-supporting articulated hemispherical dome comprising:

two pivot assemblies which are spaced and rotatably aligned along a common horizontal pivot axis;

two opposing dome halves each comprising a plurality of flat and flexible fins which are sized in progression, bent along a hemispherical arc and rotatably pinned at respective opposing ends to said pivot assemblies, each of said dome halves being movable between an open position wherein said respective fins are stacked in substantially overlying relation on a respective side of said horizontal pivot axis, and a closed position wherein trailing edge portions of each of said fins overlap adjacent portions of adjacent fins to form a continuous dome surface, said opposing dome halves overlapping at a meridian of said dome when said dome halves are in said closed position to form a continuous sealed hemispherical closure; and means for maintaining a relative spacing of the trailing edges of said fins when said dome halves are moved from said open position to said closed position.

2. The dome of claim 1 wherein said means for maintaining a spacing of the trailing edges of the fins comprises measured lengths of flexible cord attached between adjacent trailing edges of the fins.

3. The dome of claim 2 wherein said cords are attached at the center of the trailing edge of the fins.

4. The dome of claim 1, wherein said cords are attached by fasteners, said fasteners acting as stops to prevent the domes overlapping fins from fully overlaying each other and binding together as the dome is opened.

5. The dome of claim 1, wherein each of said dome halves includes a top fin, one of said top fins including a continuous flexible gasket running from end to end.

6. The dome of claim 1, wherein said fins are captured on said pivot assemblies by metal disks which maintain their positions at right angles to the pivot assemblies for maintaining the hemispherical shape of the dome.

* * * * *